US009074419B2

(12) United States Patent
Schoch et al.

(10) Patent No.: US 9,074,419 B2
(45) Date of Patent: Jul. 7, 2015

(54) WINDOW COVERING MULTI-LIFT SYSTEM

(71) Applicants: Paul Schoch, Fallbrook, CA (US); Marvin G. Schoch, Jr., Fallbrook, CA (US)

(72) Inventors: Paul Schoch, Fallbrook, CA (US); Marvin G. Schoch, Jr., Fallbrook, CA (US)

( * ) Notice: Subject to any disclaimer, the term of this patent is extended or adjusted under 35 U.S.C. 154(b) by 0 days.

(21) Appl. No.: 14/073,784

(22) Filed: Nov. 6, 2013

(65) Prior Publication Data

US 2014/0311685 A1 Oct. 23, 2014

Related U.S. Application Data

(60) Provisional application No. 61/722,992, filed on Nov. 6, 2012.

(51) Int. Cl.

| | |
|---|---|
| ***E06B 9/264*** | (2006.01) |
| ***E06B 9/72*** | (2006.01) |
| ***E06B 9/26*** | (2006.01) |
| *E06B 9/68* | (2006.01) |
| *E06B 9/262* | (2006.01) |

(52) U.S. Cl.

CPC ... *E06B 9/72* (2013.01); *E06B 9/26* (2013.01); *E06B 9/68* (2013.01); *E06B 2009/2622* (2013.01); *E06B 2009/6818* (2013.01)

(58) Field of Classification Search

CPC ..... E06B 2009/2423; E06B 2009/2458
USPC ..... 160/87, 113, 115, 124, 125, 169, 167 R, 160/168.1 P, 84.01, 84.02, 254, 255, 252, 160/121.1

See application file for complete search history.

(56) References Cited

U.S. PATENT DOCUMENTS

| | | | | |
|---|---|---|---|---|
| 4,813,468 | A * | 3/1989 | Fraser | 160/84.03 |
| 4,953,610 | A * | 9/1990 | Phillips et al. | 160/84.03 |
| 7,686,059 | B2 * | 3/2010 | Jarosinski et al. | 160/84.03 |
| 8,561,665 | B2 * | 10/2013 | Lin | 160/84.03 |
| 2014/0311685 | A1 * | 10/2014 | Schoch | 160/84.02 |

* cited by examiner

*Primary Examiner* — Blair M Johnson

(74) *Attorney, Agent, or Firm* — San Diego IP Law Group LLP

(57) ABSTRACT

The present invention provides a top down-bottom up shade multi-lift system for a plurality of windows. The multi-lift system comprises a master shade and one or more slave shades. The master shade comprises two motors. The salve shades do not include any motor. Rather, the salve shades are motorized via the motors of the master shade.

19 Claims, 9 Drawing Sheets

WINDOW COVERING MULTI-LIFT SYSTEM

CROSS REFERENCE TO RELATED APPLICATIONS

This application claims priority under 35 U.S.C. §119(e) to U.S. Provisional Application No. 61/722,992, filed Nov. 6, 2012, and entitled "WINDOW COVERING MULTI-LIFT SYSTEM," the disclosure of which is hereby incorporated by reference in its entirety.

BACKGROUND OF THE INVENTION

1. Field of Invention

This invention relates to window coverings and more specifically, to techniques for raising and lowering multiple shades through the use of a single motor and for moving a single shade as well as multiple shades in a top-down, bottom-up configuration via two motors.

2. Description of Related Art

Blinds, curtains, shades, and other window coverings (a.k.a., treatments) help beautify a home as well as make it more energy efficient. For example, lowered blinds and shades are able to block light from entering closed windows on a warm sunny day, thereby mitigating waste of air conditioning expenses. Alternatively, raised blinds and shades permit light to pass through a closed window on a cold, but sunny day, thereby mitigating heating expenses to some extent. Typically, home occupants will manually raise and/or lower blinds and shades in order to adjust the desired amount of sunlight passing through a window.

A single roman or woven wood shade may be equipped with an electrical motor to mechanically raise and lower the shade. For example, manufacturers offer a roman or woven wood shade with a tube motor (a.k.a., tubular motor) built into the winding tube. These motors comprise an electric geared motor with a bidirectional output shaft having a keyed wheel near one end of the motor that lowers and raises the respective blind or shade when actuated. See, e.g., United States Patent Application No. 2010/0078137 to Angelini, the disclosure of which is incorporated by reference herein in its entirety. Such a motor may be powered by one or more batteries or an electrical outlet near the window. The motor may also be controlled wirelessly via a remote control. Conventional motorized blinds and shades are relatively expensive since each blind or shade requires an internal expensive motor and associated control circuitry.

SUMMARY OF THE INVENTION

The present invention overcomes these and other deficiencies of the prior art by providing a technique to motorize a plurality of window coverings through the use of a single motor. The motorized window covering technique disclosed herein, which is also referred to as a "multi-lift" window covering system, implements a single tube motor to raise and lower multiple window coverings such as, but not limited to blinds and shades.

In an embodiment of the invention, a multiple window covering lift system comprises: a master shade and one or more slave shades, wherein the master shade and one or more slave shades each comprise a head rail and a bottom portion; means for raising and lowering the head rails of the master shade and one or more slave shades; and means for raising and lowering the bottom portions of the master shade and one or more slave shades relative to the head rails of the respective master shade and one or more slave shades. The means for raising and lowering the head rails of the master shade and one or more slave shades comprises a first tube motor. The means for raising and lowering the bottom portions of the master shade and one or more slave shades relative to the head rails of the respective master shade and one or more slave shades comprises a second tube motor separate and apart from the first tube motor. The first tube motor and the second tube motor are disposed within the master shade. The one or more slave shades are coupled to the first tube motor and the second tube motor through a plurality of cords.

In another embodiment of the invention, a multiple window covering lift system comprises: a master shade and one or more slave shades, wherein the master shade and one or more slave shades each comprise a head rail and a bottom portion; a first tube motor coupled to the head rails of the master shade and one or more slave shades through a first set of cords; and a second tube motor coupled to the bottom portions of the master shade and one or more slave shades through a second set of cords. Actuation of the first tube motor raises or lowers the head rails of the master shade and one or more slave shades. Actuation of the second tube motor raises or lowers the bottom portions of the master shade and one or more slave shades relative to the head rails of the respective master shade and one or more slave shades. The first tube motor and the second tube motor are disposed within the master shade.

An advantage of the present invention is that the decreased expense of motorizing a plurality of window coverings as only a single motor is required—conventional window treatment systems require a motor for every window covering. Accordingly, fewer junction boxes need to be installed with less electrical wiring, thereby fewer circuits. Another advantage of the present invention is that the plurality of window coverings all lift and close at the exact same rate of speed.

Another advantage is that the window treatment/design industry has a problem automating certain window coverings that are less than 18 or 19 inches wide for an inside mount installation because the motors are presently wider than that length. In addition, when a room has a series of windows and one is too narrow, there are only a few options available. One is to put a non-operational or corded treatment in that window and motorize the other window treatments. Another is to forego the motorization all together. The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF EMBODIMENTS

Figure 1:
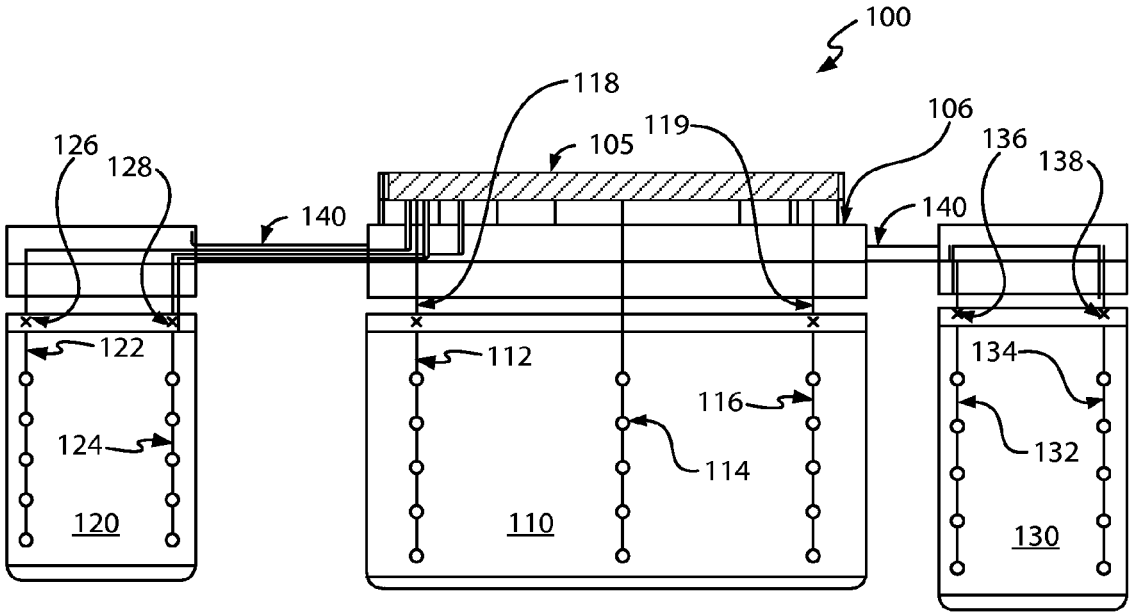
FIG. 1 illustrates a shade multi-lift system according to an embodiment of the invention.

Further features and advantages of the invention, as well as the structure and operation of various embodiments of the invention, are described in detail below with reference to the accompanying FIGS. 1-10, wherein like reference numerals refer to like elements. Although the invention is described in the context of roman shades, one of ordinary skill in the art readily appreciates that the present invention can be implemented in other types of window treatments such as, but not limited to roller shades, awnings, fabric shades including, but not limited to Austrian shades, back tuck shades, front tuck shades, and flat shades, woven wood shades, mini-blinds, 2 inch and 3 inch tilt slat blinds, sangria 1*a* and silhouette blind style shades, pleated shades, double sun blocking and sun filtering cell shades.

FIG. 1 illustrates a top down-bottom up shade multi-lift system 100 according to an embodiment of the invention. Top down-bottom up refers to the ability of the shade to be drawn opened and closed (i.e., lower and raised) relative to the top portion of the shade, as well as the entire shade being able to move relative to the applicable window. As illustrated, the shade multi-lift system 100 comprises a master shade 110 and two slave shades 120 and 130. Although two slave shades are shown, other embodiments of the invention may include only one slave shade or three or more slave shades. The master shade 110 comprises a first tube motor 105 and a second tube motor 106. The slave shades 120 and 130 do not include any type of motor. Rather, as described in more detail below, the slave shades 120 and 130 are motorized via the tube motor 105 and tube motor 106 of the master shade 110. Although not shown, the master shade 110 and slave shades 120 and 130 are each affixed to or near a window frame of a corresponding window, i.e., shades 110, 120, and 130 collectively cover three windows.

The tube motor 105 is coupled to the shade material of the master and slave shade 110, 120 and 130 via cords 112, 114, 116, 122, 124, 132 and 134. The tube motor 106 is coupled to the shade material of head rail (or "C" Rail) of the blind 110 via cords 118 and 119. The illustration of the cords 112, 114, 116, 118, and 119 is exemplary only and in other embodiments, any number of cords may be used depending on, among other things, the size and/or weight of the shade material. The shade material may comprise fabric, plastic such as vinyl, wood, aluminum and other metals, and cellular materials. One end of the cords 112, 114, and 116 is attached to the tube motor 105. The other end of the cords 112, 114, and 116 is attached to the bottom of the blind material. The master shade 110 is depicted in its fully lowered position. Upon actuation of the tube motor 105, the shade material is raised relative to its head rail as the motor 105 rotates and thereby, winds the cords 112, 114, and 116 around its outer surface. Rotating the motor 105 in the opposite direction unwinds the cords 112, 114, and 116, thereby lowering the shade material relative to its head rail. In other words, tube motor 105 actuates the opening and closing of the shade 110.

One end of cords 118 and 119 are attached to the second tube motor 106 and the other end of cords 118 and 119 are attached to the "C" head rail for the top-down option to operate. Upon actuation of the motor 106, the "C" head rail and hence the entire blind 110 is raised and lowered depending on the rotation direction of the motor.

Tube motor 105 is also coupled to cords 122 and 124 of slave shade 120 and cords 132 and 134 of slave shade 130. One end of the cords 122, 124, 132, and 136 is attached to the tube motor 105. The other end of the cords 122, 124, 132, and 136 is attached to the bottom of the respective shade material. The cords 122, 124, 132, and 136 travel through one or more conduits 140, which are ideally frictionless or near frictionless in order to prevent the cords from being hung up. When the tube motor 105 is actuated, for example, in a raising state, the shade material of slave shades 120 and 130 is raised as the motor rotates and winds the cords 122, 124, 132, and 136 around its outer surface. Rotating the motor 105 in the opposite direction unwinds the cords 122, 124, 132, and 136, thereby lowering the respective shade materials. In a preferred embodiment of the invention, the particular length of cords 122, 124, 132, and 136 is optimally set in order to synchronize the movement of shades 110, 120, and 130, i.e., the bottom of all three shades form a straight line during raising and lowering.

Likewise, tube motor 106 is also coupled to cords 126 and 128 of slave shade 120 and cords 136 and 138 of slave shade 130. One end of the cords 126, 128, 136, and 138 is attached to the tube motor 106. The other end of the cords 126, 128, 136, and 138 is attached to the head rail of the respective shade material. The cords 126, 128, 136, and 138 travel through the one or more conduits 140. When the tube motor 106 is actuated, for example, in a raising state, the head rail of slave shades 120 and 130 is raised as the motor rotates and winds the cords 126, 128, 136, and 138 around its outer surface. Rotating the motor 106 in the opposite direction unwinds the cords 126, 128, 136, and 138, thereby lowering the head rails. In a preferred embodiment of the invention, the particular length of cords 126, 128, 136, and 138 is optimally set in order to synchronize the movement of shades 110, 120, and 130, i.e., the head rails of all three shades form a straight line during raising and lowering.

The shades 110, 120, and 130 may each include aesthetic treatments referred to as A-Rail, B-Rail, C-Rail, and D-Rail. As explained in further detail below, the joining of an A-Rail and B-Rail form an internal conduit for cords 122, 124, 132, and 136. C-Rail and D-Rail are optional respective head rail and bottom rail treatments.

In an alternative embodiment, micro-switches or optical sensors may be employed to start or stop the motors 105 and 106. For example, a switch may be deployed on the bottom of the B-Rail. When the switch is in a closed position, i.e., the C-Rail is pressed against the B-Rail sufficiently, the D-Rail may be raised and lowered via motor 105. When this switch becomes open, i.e., the C-Rail has moved away from the B-Rail by activation of the motor 106, motor 105 is rendered inoperable. This prevents the cords from overly-slacking or tangling up and breaking.

In another embodiment, the shades 110, 120, and 130 comprise two sections, on one of which is opaque (i.e., doesn't allow the majority of light to pass through) and another which is translucent (i.e., does allow the majority of light to pass through). For example, a bottom portion of the shade is opaque. When the applicable shade is lowered via motor 106, say halfway, the opaque shade is folded up at the bottom of the window and only the translucent portion is shown. Similarly, the shade can be raised so that only the opaque shade is exposed. This way, one can alternative between opaque and translucent shades.

Figure 2:
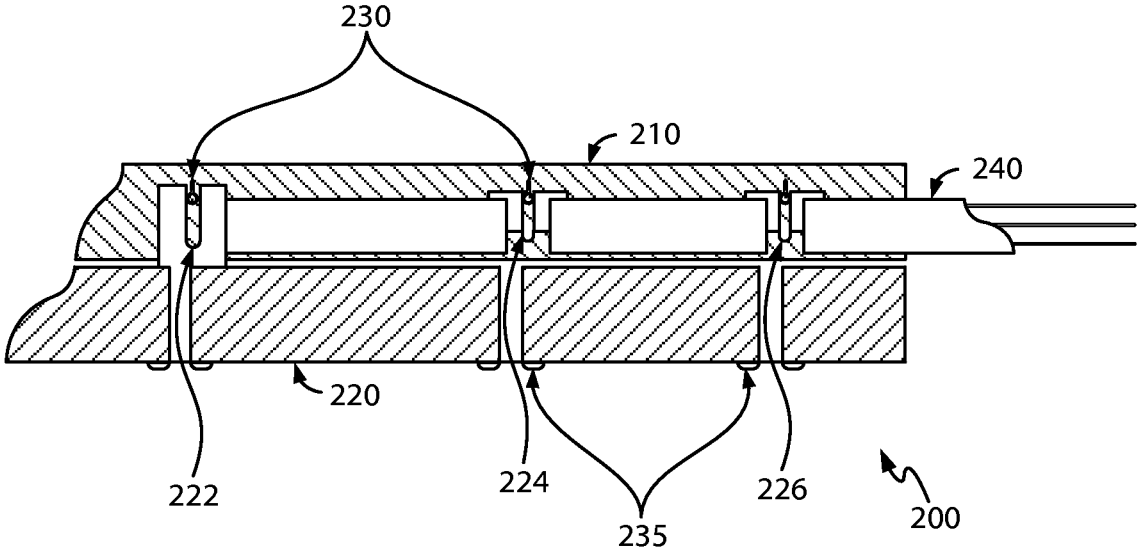
FIG. 2 illustrates a slave shade two-piece head rail according to an exemplary embodiment of the invention.

FIG. 2 illustrates a slave shade 200 according to an exemplary embodiment of the invention. Here, only the top portion of the shade 200 is shown. The slave shade 200 comprises a A-Rail 210, a B-Rail 220, lift cords 222, 224, and 226, multiple eye screws 230, multiple ferrules 235, an a conduit 240. One end of each cord 222, 224, and 226 is attached to a bottom portion (not shown) of the respective blind material of blind 200. The other end of each cord 222, 224, and 226 is attached to a motor (not shown) of a master shade (not shown). The cords 222, 224, and 226 pass through the B-Rail 220, the openings of which are protected by one or more ferrules 235, then through one or more eye screws 230 into the conduit 240, and on to a motor of the master shade. The eye screws 230 and ferrules 235 mitigate friction as the cords 222, 224, and 226 travel. In an embodiment of the invention, the conduit 240 comprises ¼ inch vinyl, aluminum, or copper tubing. Alternatively, the conduit comprises ⅛ inch vinyl, aluminum, or copper tubing.

Figure 3:
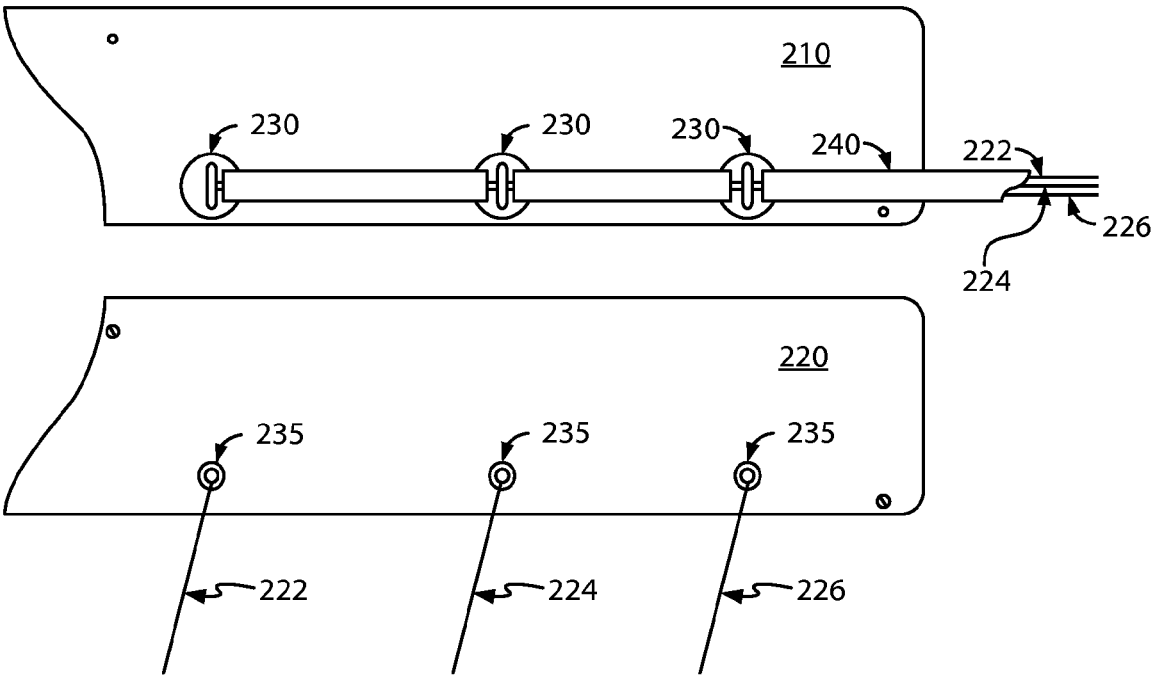
FIG. 3 illustrates the slave shade of FIG. 2.

FIG. 3 illustrates the slave shade 200 with the A-Rail 210 and B-Rail 220 not affixed to one another in order to better show the eye screws 220 and ferrules 235. In actual use, the A-Rail 210 and B-Rail 220 would be joined to one another as shown in FIG. 2 (as well as FIG. 4). Alternatively, eye screws 220 and ferrules 235 could be replaces with polished rollers, polished guilds and pins, pulleys, tubing that has a 90-degree sweeping bend, or plastic channel guilds.

Figure 4A:
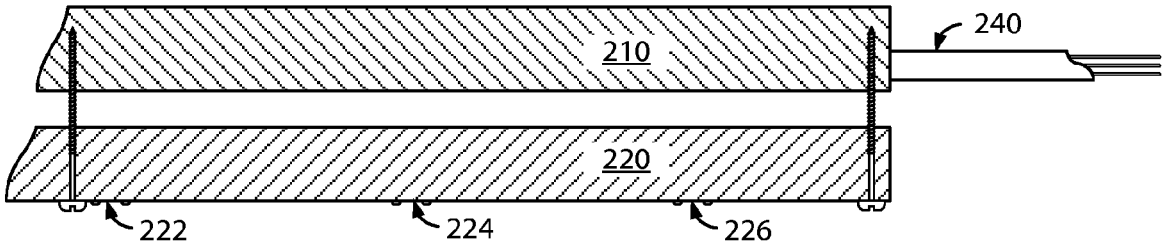
FIGS. 4A and 4B illustrate fastening of an A-Rail and B-Rail in the slave shade of FIG. 2 according to an exemplary embodiment of the invention.
Figure 4B:
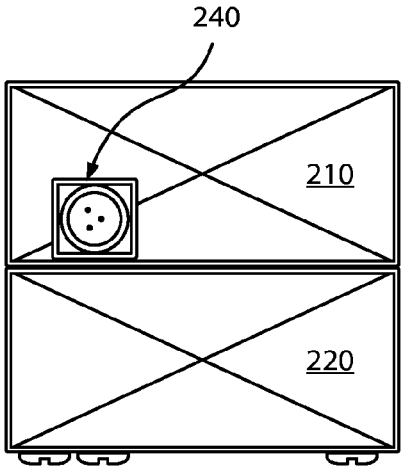

FIG. 4 illustrates fastening of the A-Rail 210 and B-Rail 220 according to an exemplary embodiment of the invention. Particularly, FIG. 4A depicts the fastening of the A-Rail 210 to the B-Rail 220 via screws. FIG. 4B depicts an end view of the A-Rail 210 and B-Rail 220 upon fastening. Here, a channel has been provided in the A-Rail 210 to house the conduit 240. The A-Rail 210 and B-Rail 220 may comprise any type of construction material such as, but not limited wood, particle board, plastic, or aluminum. Although screws are shown as a fastening means, other types of fasteners may be used, the identification and implementation of which is apparent to one of ordinary skill in the art, to join A-Rail 210 to B-Rail 220.

Figure 5:
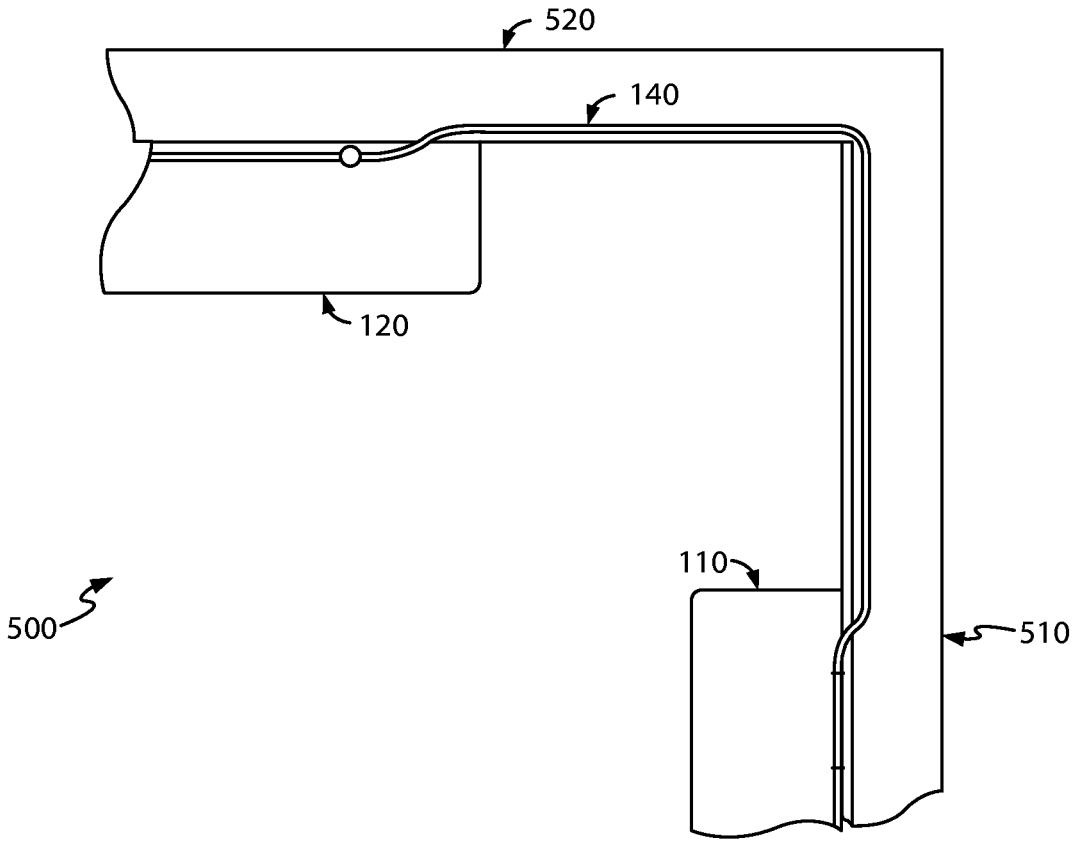
FIG. 5 illustrates a top view of shade serving a remote window. multi-lift system according to an embodiment of the invention.

FIG. 5 illustrates a top view of shade multi-lift system 500 according to an embodiment of the invention. Here, the shade multi-lift system 500 is adapted to run cords around a corner of a room. For example, referring back to FIG. 1, the master shade 110 and the slave shade 120 may cover windows not located within the same wall, i.e., plane. In other words, the master shade 110 is located on a wall 510 adjacent to a wall 520 where slave shade 120 is located. Accordingly, to compensate for the ninety degree turn in which the cords 122 and 124 must make to travel from the slave shade 120 to the motor 105 of the master shade 120, a portion of the conduit 140 may be disposed on or within the two adjacent walls 510 and 520. In one embodiment of the invention, the conduit 140 may be located internal to or within the drywall of walls 510 and 520 and covered up with spackling and matching paint to hide the presence of the conduit 140. Alternatively, the conduit 140 may be located on the outer surface of walls 510 and 520 and covered up with wood trim moldings or the like. Alternatively, the conduit 140 may be retrofitted into the framework, attics, and basements of the home and run back to a centralized area with lift motors that are remotely located.

Figure 6:
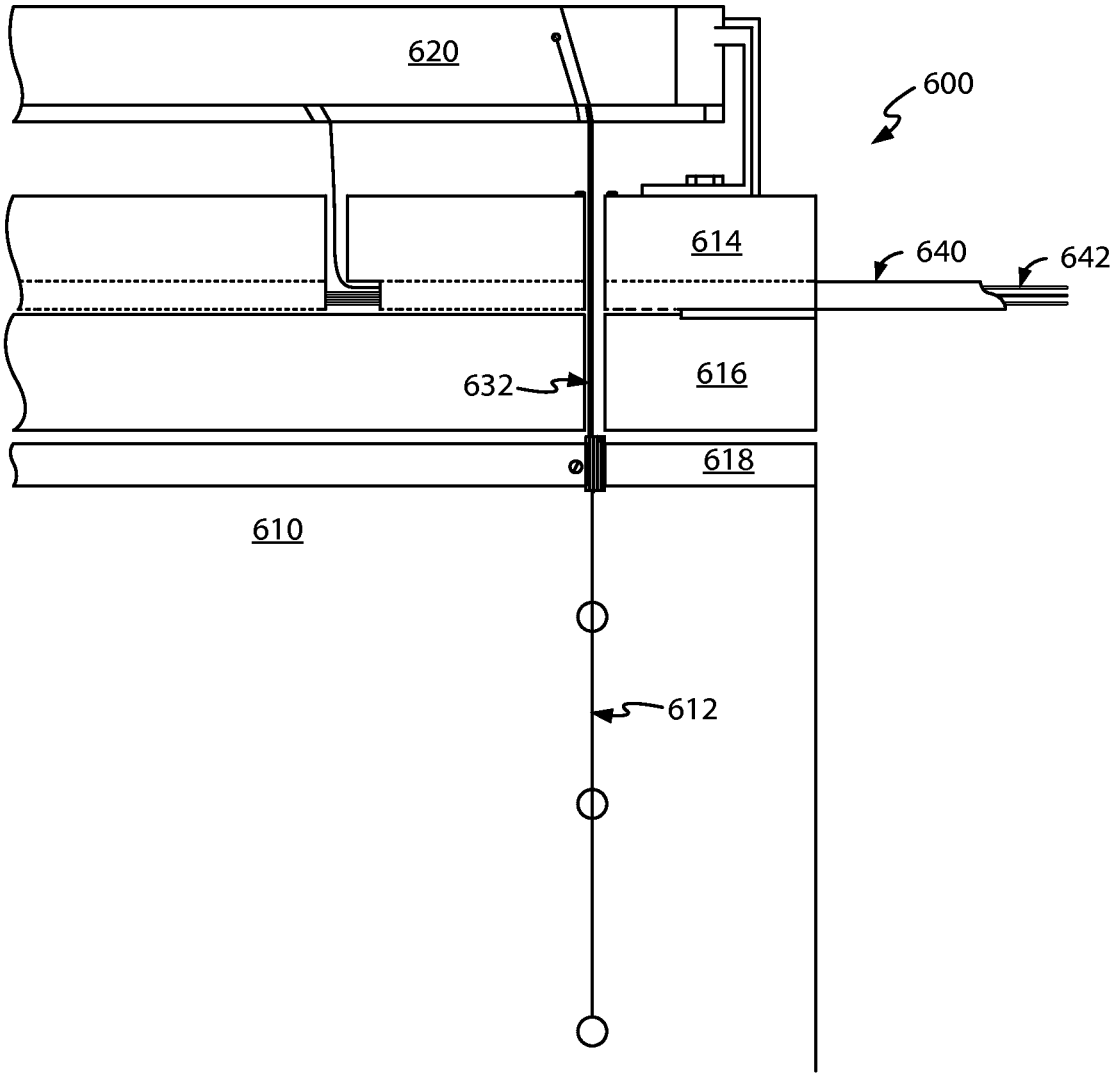
FIG. 6 illustrates a top down bottom up shade system according to an embodiment of the invention.

FIG. 6 illustrates a top down bottom up shade system 600 according to an embodiment of the invention. "Top down bottom up" refers to an entire, single shade being able to move up and down relative to a window, as well as the blind material of the single roman shade being able to move up and down relative to the top portion of the single shade. The top down bottom up shade system 600 comprises a shade 610, a first tube motor 620, and a second tube motor 630 (not shown, but hidden). The shade 610 comprises a lift cord 612, an A-Rail 614, a B-Rail 616, a C-Rail 618, and a D-Rail (not shown). One end of the lift cord 612 is attached to a bottom portion (not shown) of the respective blind material of blind 610. The other end of each the cord 612 is attached to the first motor 620. The shade 610 is depicted in its fully lowered position. Upon actuation of the first motor 620, the blind material is raised as the motor 620 rotates and thereby, winds the cord 612 around its outer surface. Rotating the motor 620 in the opposite direction unwinds the cord 612, thereby lowering the blind material.

The second tube motor 630 is coupled to the C-Rail 618 of the shade 610 through a lift cord 632. Particularly, one end of the lift cord 632 is attached to a termination point on the C-Rail 618. The other end of the lift cord 632 is attached to the second motor 630. Upon actuation of the second motor 630, the entire shade 610 is raised as the motor 630 winds the cord 632 around its outer surface. Rotating the motor 630 in the opposite direction unwinds the cord 632, thereby lowering the entire shade 610.

In an optional embodiment of the invention, the first motor 620 can be used to drive a slave shade (not shown) via a conduit 640 and one or more lift cords 642 coupled to the slave shade.

Figure 7A:
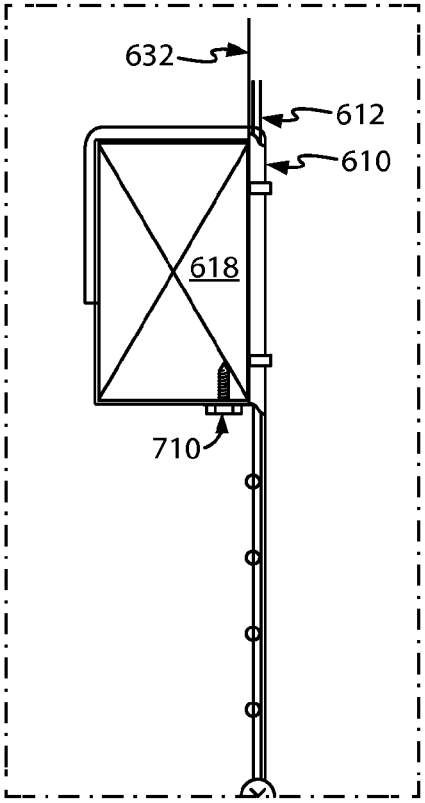
FIGS. 7A and 7B illustrate a side view of the top down bottom up shade system of FIG. 6 according to an exemplary embodiment of the invention.
Figure 7B:
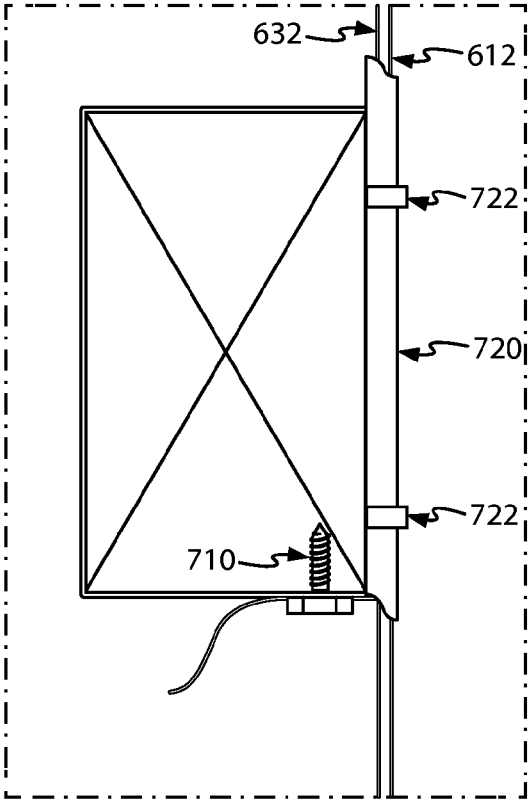

FIG. 7 illustrates a side view of the top down bottom up shade system 600 according to an exemplary embodiment of the invention. Particularly, FIG. 7A shows a lift cord 632 attached to the C-Rail 618 via an anchor screw 710. FIG. 7B (which shows a portion of FIG. 7A in greater detail) shows that the lift cord 632, as well as the lift cord 612, travels through a conduit 720, which is attached to the C-Rail 618 via staples 722. In an embodiment of the invention, the conduit 720 comprises ⅛$^{th}$ inch vinyl tubing.

Figure 8:
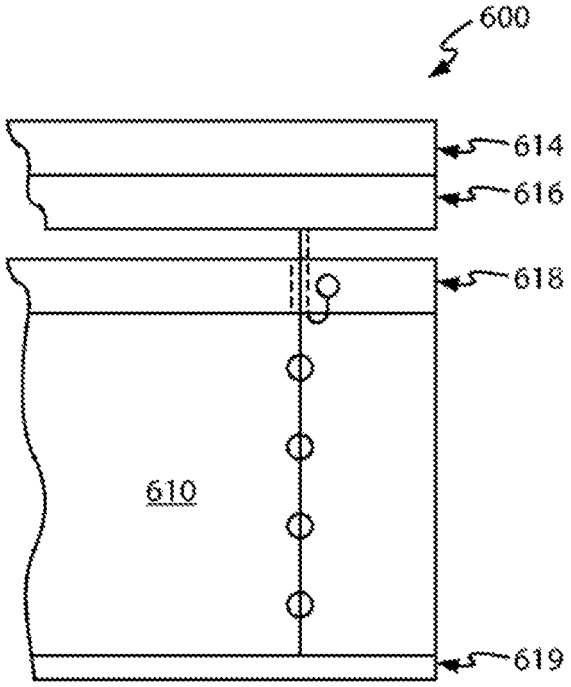
FIG. 8 illustrates the movement of the top down bottom up shade system of FIG. 6.

FIG. 8 illustrates the movement of the top down bottom up shade system 600. In one instance, the shade 610 is able to move up and down relative to the A-Rail 614 and the B-Rail 616. In another instance, the blind material of the shade 610 is able to be raised and lowered relative to the C-Rail 618, i.e., the D-Rail 619 can be raised and lowered relative to the C-Rail. If both the first motor 620 and second motor 630 are actuated at the same time, both of the above-noted instances of movement may occur simultaneously.

Figure 9:
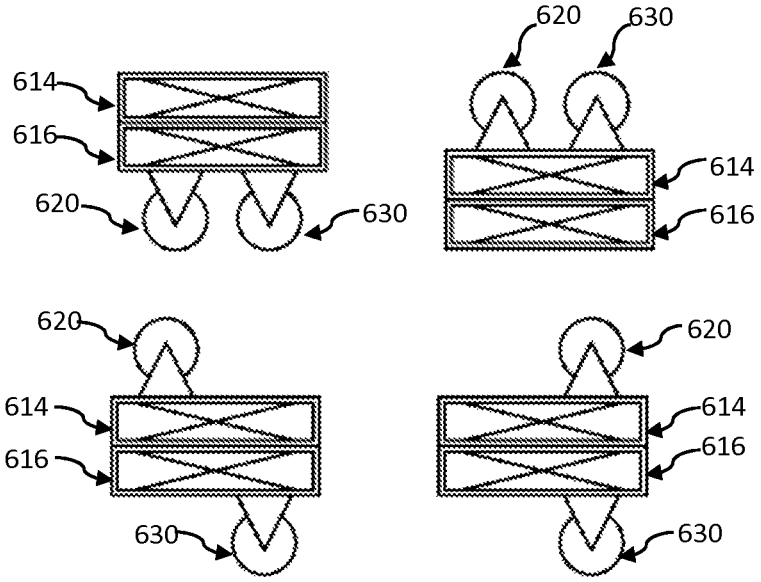
FIG. 9 illustrates location of the two motors in the top down bottom up shade system of FIG. 6 according to exemplary embodiments of the invention.

FIG. 9 illustrates different attachment configurations of the first motor 620 and second motor 630 to the A-Rail 614 and B-Rail 616 according to exemplary embodiments of the invention.

Figure 10:
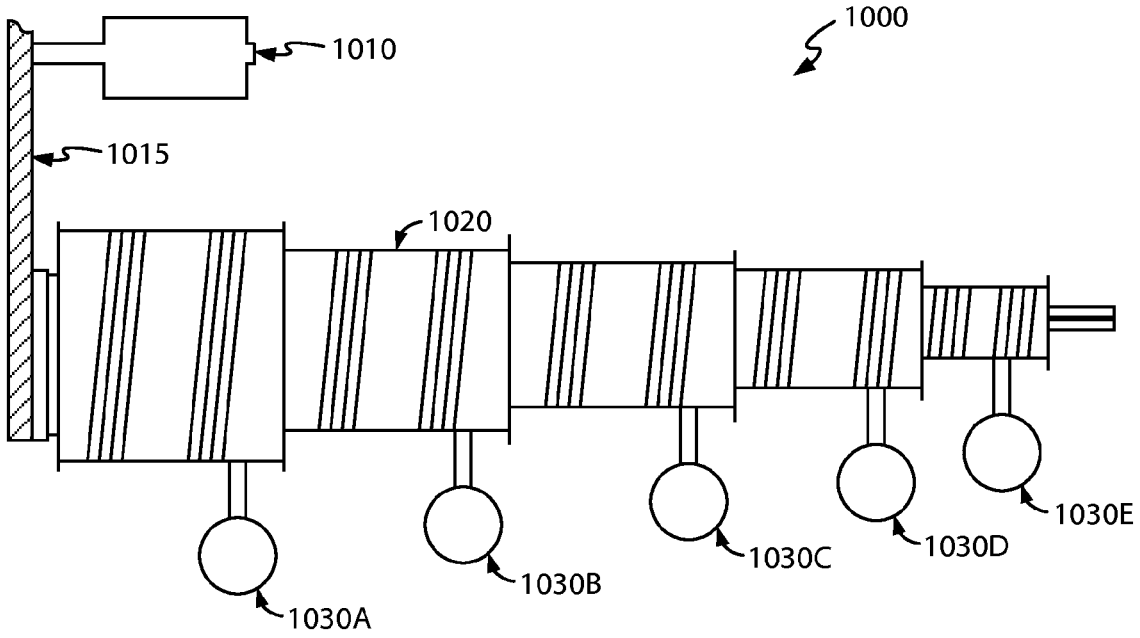
FIG. 10 illustrates a multiple window shade lift system according to an embodiment of the invention.

FIG. 10 illustrates a multiple window shade lift system 1000 according to an embodiment of the invention. Here, the system 1000 comprises a single motor 1010 and a drum assembly 1020, which is driven by the motor via a belt 1015. The drum assembly comprises differently sized, i.e., varying diameters, cylinders 1020A, B, C, D, and E. Each cylinder 1020A-E is associated with a window shade. Thus, in the embodiment shown, drum assembly is coupled to five windows. One of ordinary skill in the art recognizes that any number of cylinders and hence windows may be implemented. Each cylinder 1020A-E is coupled to one or more lift cords that are coupled to the respective window shade. The varying diameters of the cylinders 1020A-E will draw or release the respective lift cords at varying speeds—speed increases as the diameter increases. Thus, the cylinders 1020 can be appropriately sized to raise and lower a window shade at a desired speed. Accordingly, the single motor 1010 can lift multiple window shades in several different rooms of a building. The system 1000 can be located in an attic, closet, or wherever is appropriate (ideally hidden from view). Optionally, actuators 1030A-E may be employed to engage and disengage the respective cylinders 1020A-E.

Remote automation can be implemented via the use of temperature sensors, which trigger the raising and lowering of the blinds if the applicable room gets too hot or too cold and home automation system.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A multiple window covering lift system comprising:

a master shade for covering a first window of a first window frame, the master shade comprising a head rail, shade material, a first motor, and a second motor; and a slave shade for covering a second window of a second window frame, the slave shade comprising a head rail and shade material;

wherein actuation of the first motor raises or lowers the head rail of the master shade relative to the first window and raises or lowers the head rail of the slave shade relative to the second window, the raising or lowering of the head rail of the master shade is synchronized with the respective raising or lowering of the head rail of the slave shade, and the first window frame is separate and apart from the second window frame; and wherein actuation of the second motor raises or lowers the shade material of the master shade relative to the head rail of the master shade and raises or lowers the shade material of the slave shade relative to the head rail of the slave shade, the raising or lowering of the shade material of the master shade is synchronized with the respective raising or lowering of the shade material of the slave shade.

2. The system of claim 1, wherein the the first motor comprises a tube motor.

3. The system of claim 2, wherein the the second motor comprises a tube motor.

4. The system of claim 3, wherein the first motor and the second motor are hidden and disposed within the master shade.

5. The system of claim 4, further comprising a conduit linking the master shade to the slave shade, wherein the head rail and the shade material of the slave shade are coupled to the first motor and the second motor through a plurality of cords running through the conduit.

6. The system of claim 5, wherein the first window frame is disposed on a first wall and the second window frame is disposed on a second wall adjacent to the first wall, the first wall and second wall are not coplanar.

7. The system of claim 5, wherein the slave shade further comprises an A-Rail and a B-Rail, the A-Rail including a channel to house a portion of the conduit, wherein the A-Rail is joined to the B-Rail through one or more fasteners.

8. The system of claim 6, wherein the conduit is hidden and housed within the first wall and the second wall.

9. The system of claim 5, further comprising a temperature sensor, wherein the temperature sensor triggers actuation of the first motor and/or the second motor.

10. A multiple window covering lift system comprising:

a master shade for covering a first window of a first window frame and, the master shade comprising a head rail, shade material, a first tube motor, and a second tube motor; and a slave shade for covering a second window of a second window frame, the slave shade comprising a head rail and shade material;

a first tube motor coupled to the head rail of the master shade and the head rail of the slave shade through a first set of cords, wherein actuation of the first tube motor moves the first set of cords to synchronously raise or lower the head rail of the master shade relative to the first window and the head rail of the slave shade relative to the second window, and the first window frame is separate and apart from the second window frame; and a second tube motor coupled to the shade material of the master shade and the shade material of the slave shade through a second set of cords, wherein actuation of the second tube motor moves the second set of cords to synchronously raise or lower the shade material of the master shade relative to the head rail of the master shade, and the shade material of the slave shade relative to the head rail of the slave shade.

11. The system of claim 10, wherein the first tube motor and the second tube motor are disposed within the master shade.

12. The system of claim 10, further comprising a conduit linking the master shade to the slave shade, wherein the conduit provides travel of the first set of cords and the second set of cords.

13. The system of claim 12, wherein the first window frame is disposed on a first wall and the second window frame is disposed on a second wall adjacent to the first wall, the first wall and second wall are not coplanar.

14. The system of claim 10, wherein the slave shade further comprises an A-Rail and a B-Rail, the A-Rail including a channel to house a portion of the conduit, wherein the A-Rail is joined to the B-Rail through one or more fasteners.

15. The system of claim 13, wherein the conduit is hidden and housed within the first wall and the second wall.

16. The system of claim 10, further comprising a temperature sensor, wherein the temperature sensor triggers actuation of the first tube motor and/or the second tube motor.

17. A multiple window covering lift system comprising:

a master shade for covering a first window of a first window frame, the master shade comprising a head rail, shade material, and a first motor; and a slave shade for covering a second window of a second window frame, the slave shade comprising a head rail and shade material;

wherein the first motor comprises a drum assembly, the drum assembly comprising a first cylinder and a second cylinder, and a diameter of the first cylinder is different than a diameter of the second cylinder, wherein the first cylinder is coupled to the head rail or shade material of the master shade through a first set of cords, and wherein the second cylinder is coupled to the head rail or shade material of the slave shade through a second set of cords.

18. The multiple window covering lift system of claim 17, wherein actuation of the first motor raises or lowers the head rail of the master shade relative to the first window and raises or lowers the head rail of the slave shade relative to the second window, the respective raising or lowering of the head rails of the master shade and the slave shade occurring at different speeds.

19. The multiple window covering lift system of claim 17, wherein actuation of the first motor raises or lowers the shade material of the master shade relative to the head rail of the master shade and raises or lowers the shade material of the slave shade relative to the head rail of the slave shade, the respective raising or lower of the shade materials of the master shade and the slave shade occurring at different speeds.

* * * * *